US005224428A

United States Patent [19]

Wronkiewicz

[11] Patent Number: 5,224,428

[45] Date of Patent: Jul. 6, 1993

[54] STRENGTHENED STRUCTURE FOR A STEERING ARM ASSEMBLY HAVING A COMPOUND RADIAL FILLET AT JUNCTURE

[76] Inventor: Robert D. Wronkiewicz, 930 S. Seminary Ave., Park Ridge, Ill. 60068

[21] Appl. No.: 786,042

[22] Filed: Oct. 31, 1991

[51] Int. Cl.[5] ..... B61F 5/50

[52] U.S. Cl. ..... 105/167; 105/168; 105/463.1

[58] Field of Search ..... 105/165, 167, 168, 463.1

[56] References Cited

U.S. PATENT DOCUMENTS

| | | | |
|---|---|---|---|
| 2,296,106 | 9/1942 | Holland et al. | 105/167 |
| 2,360,061 | 10/1944 | Jones | 105/167 |
| 3,789,770 | 2/1974 | List | 105/168 |
| 4,131,069 | 12/1978 | List | 105/168 |
| 4,455,946 | 6/1984 | List | 105/168 |
| 4,655,143 | 4/1987 | List | 105/168 |
| 4,781,124 | 11/1988 | List | 105/168 |
| 4,889,054 | 12/1989 | List | 105/167 |
| 4,976,362 | 12/1990 | Kaufhold | 213/152 |

OTHER PUBLICATIONS

"Stress Concentration Factors", R. E. Peterson; John Wiley & Sons; New York; 1974; pp. 83-86.

"Design Rationale for a New Lightweight, Heavy Duty Freight Truck"; H. A. List; Presented at the American Society of Mechanical Engineers; Nov., 1985.

*Primary Examiner*—Robert J. Oberleitner

*Assistant Examiner*—S. Joseph Morano

[57] ABSTRACT

A steering arm assembly for a railway truck has compound fillets between the cross-beam or body portion and each sidearm to provide increased flexural strength to the assembly while maintaining the clearance between the steering arm and truck components.

4 Claims, 2 Drawing Sheets

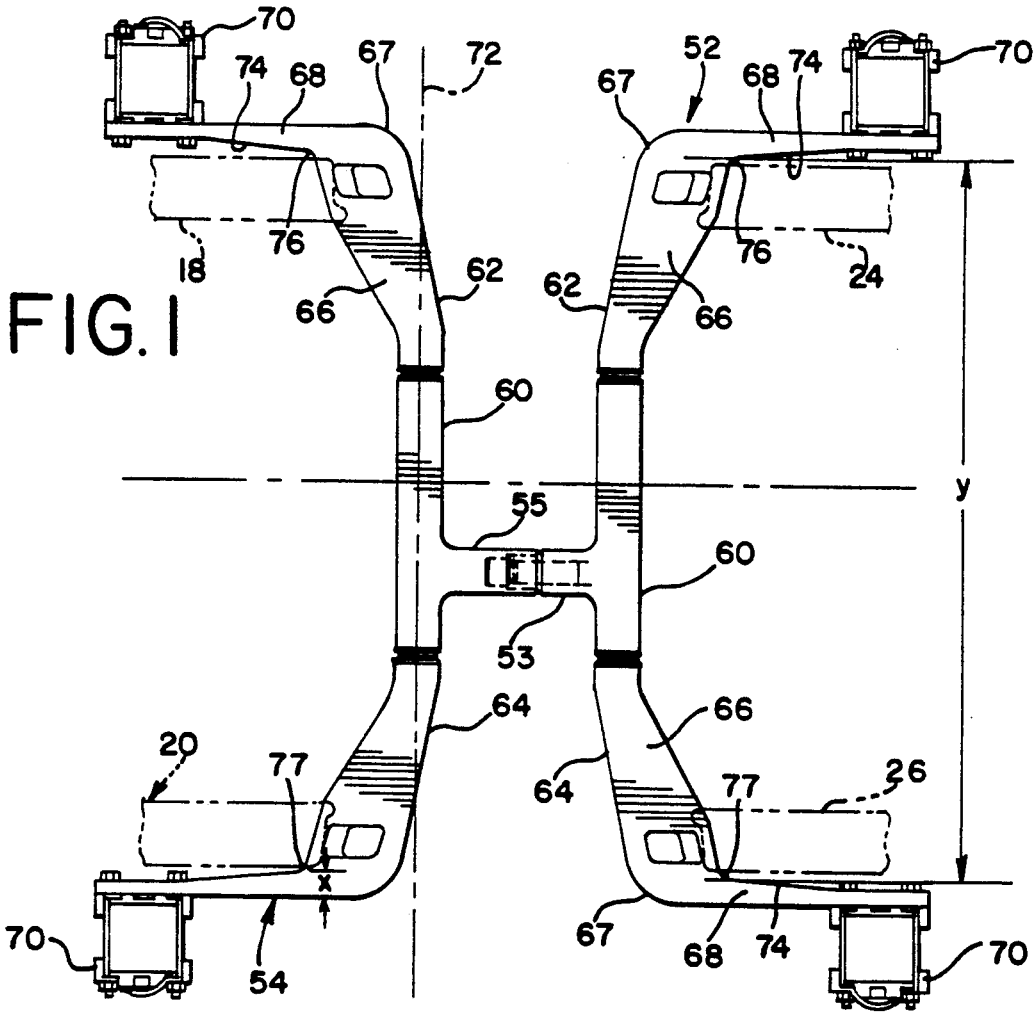
FIG. 1
FIG. 2
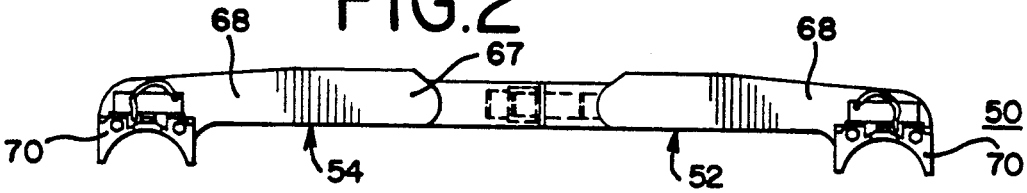
FIG. 6
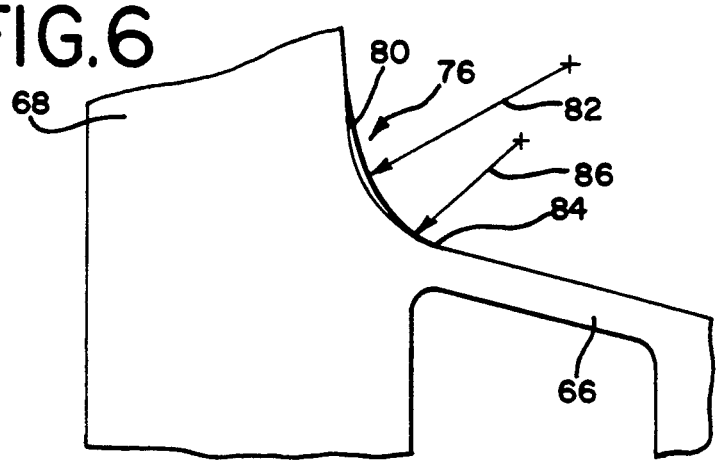

STRENGTHENED STRUCTURE FOR A STEERING ARM ASSEMBLY HAVING A COMPOUND RADIAL FILLET AT JUNCTURE

BACKGROUND OF THE INVENTION

The present invention relates to steering arms for railway trucks. More specifically, the junction of the side arms and cross-beam in a U-Shaped steering arm is provided with a compound fillet to improve the flexural strength and reduce the sensed stress loads between the side arm and cross-beam without encumbering or interfering with either the wheel position or operation.

Side trucks or steering arms for a vehicle truck are utilized to control railroad car trucks, especially against hunting or lateral movement during radial travel around curves. An early truck model with steering arms is illustrated in U.S. Pat. No. 2,360,061 to L. B. Jones, which provided a car truck with two interconnected sub-components capable of independent swiveling movement. The steering arms project diagonally from a common central point to projecting side arms coupled to the axles of each wheelset, and the car trucks independently swivel relative to the car body while rounding track curves. The diagonal braces emanating from the center pivot are illustrated with generally single radiused corners at their intersection with the side arms, which radius is usually large. In these early-model trucks, the large radii steering arms are not limited by potential interference with ancillary truck components, such as bolsters, side frames and wheels.

The objective of any of the radial trucks is adjustment of the axles, bolster and side frame motion to accommodate radial movement around curves for relief of the lading from the shocks and jars incident to the contact between rails and wheel flanges. In U.S. Pat. No. 2,296,106 to Holland et al, a pair of yokes is attached to the saddle of the car at each side of the car, and each yoke is operatively connected to the center of the bolster. The yoke arms extend from the bolster center at a generally acute angle to the longitudinal direction of car travel with the sidearms formed to couple with saddles at each wheel. The separation distance between bolster, side frame and wheels in this assembly provides adequate clearance for the yoke and yoke operation.

Recent developments in steering arms for articulated railway trucks have concentrated on problems of lateral restraint and yaw flexibility between the two wheelsets of a truck, to prevent high speed hunting. These changes in steering arm structures for self-steering wheelsets are illustrated in U.S. Pat. No. 4,781,124 to List. However, it is evident in the illustrations that the sidearms of the steering arm structures project generally normal to the steering arm cross-beam in proximity to the wheel, which minimizes the available space for the components.

The lack of a large clearance distance for the steering-arm components is readily apparent in the List—'124 patent and, as a consequence, the intersection of the steering-arm cross-beam and sidearm is approximately a right angle. In operation, there is a repeated flexural load paced upon the joint intersection of these modern steering arm structures. As the noted clearances between the wheel and steering arm are minimal, it has been necessary to utilize a circular radius in the intersecting shoulder, which is adequate for structural arrangements, but would preferably be stronger to reduce the stresses on the sidearm, such as by enlarging the circular radius. However, the wheel, side frame and bolster clearances and steering arm size have combined to preclude or limit development of a stronger junction relationship between the side arms and cross-beam.

Although it is known that the addition of a greater mass to a joint or a larger radius in a corner junction would act to increase the strength of the junction, these alternatives are not available in many modern steering arm apparatus with the above-noted clearance constraints. A discussion of alternatives for increasing strength of intersecting arms or segments is provided in *Stress Concentration Factors*, by R. E. Peterson, John Wiley and Sons, 1974. The effects of fillets with a non-circular component and their impact on the stress concentration are discussed at page 83–86, ibid. It is noted that although circular fillets are utilized for ease of machining and drafting, they do not provide the minimum stress concentration.

The development of stronger steering-arm component junctions or connections would allow tighter control of both the lateral restraint and yaw flexibility of the wheelsets, the truck and thus the rail car with minimal, if any, added cost. Further, greater control of truck "hunting," especially in curves and at high speeds, enhances the safe operation of railway cars.

SUMMARY OF THE INVENTION

The present invention provides an improved shoulder structure for a truck steering-arm at each junction of its cross-beam and associated side arms. More specifically, the shoulder is provided with an elliptical or compound fillet sidewall, that is an inner sidewall, having a first and a second radius in the junction shoulder, which provides both more mass at the junction and a larger arced segment to improve the flexural strength of the steering arm assembly, and particularly the flexural strength at the junction between the cross-beam and sidearm. This increase in bending or flexural strength is accomplished within the minimal available space between the steering arm and wheel, without broad changes in the structure of the steering arm assembly and without disabling normal operation of the steering arm or wheel.

BRIEF DESCRIPTION OF THE DRAWING

In the several figures of the Drawing like reference numbers refer to like elements, and in the drawing;

FIG. 1 is a plan view of an exemplary steering arm assembly;

FIG. 2 is an elevational view of the steering arm assembly of FIG. 1;

DETAILED DESCRIPTION OF THE PREFERRED EMBODIMENT

Figure 3:
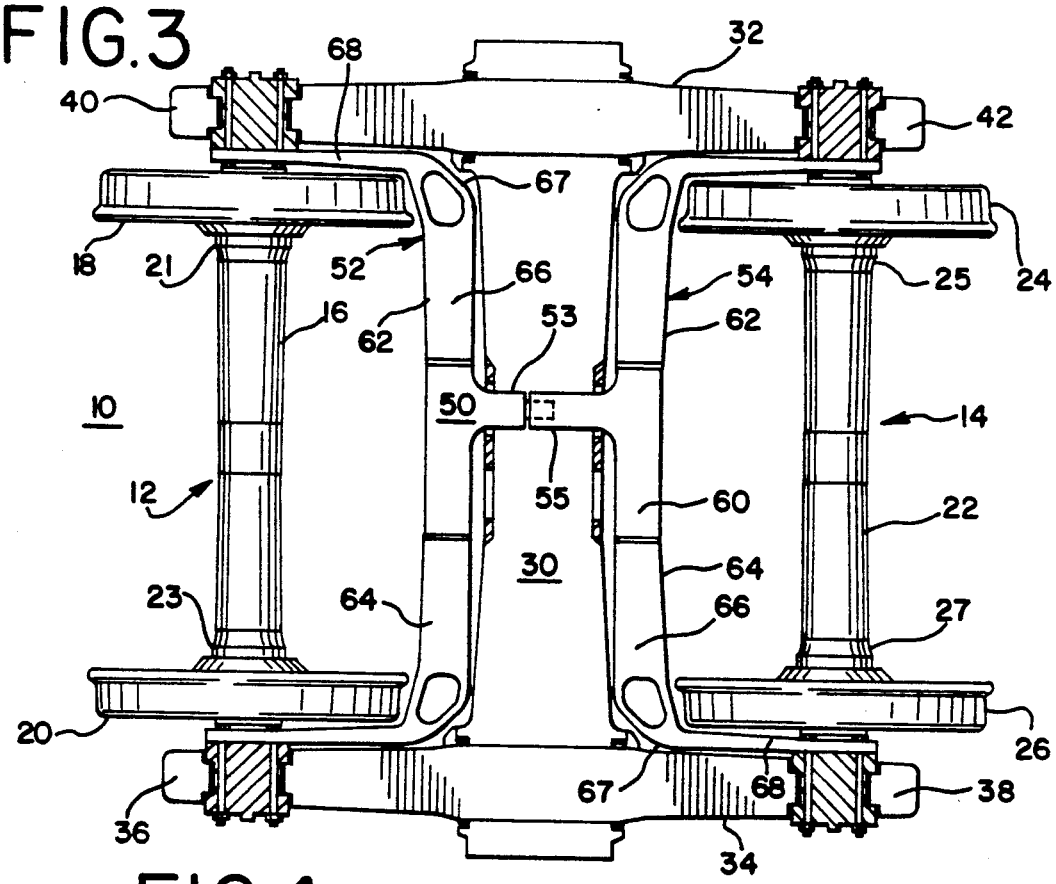
FIG. 3 is a plan view of an illustrative railway truck and steering arm assembly.
Figure 4:
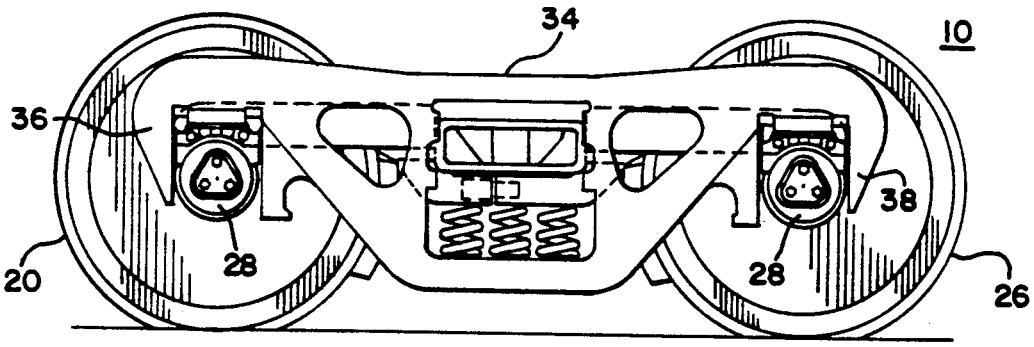
FIG. 4 is a side elevational view of the truck and steering arm assembly of FIG. 3.
Figure 5:
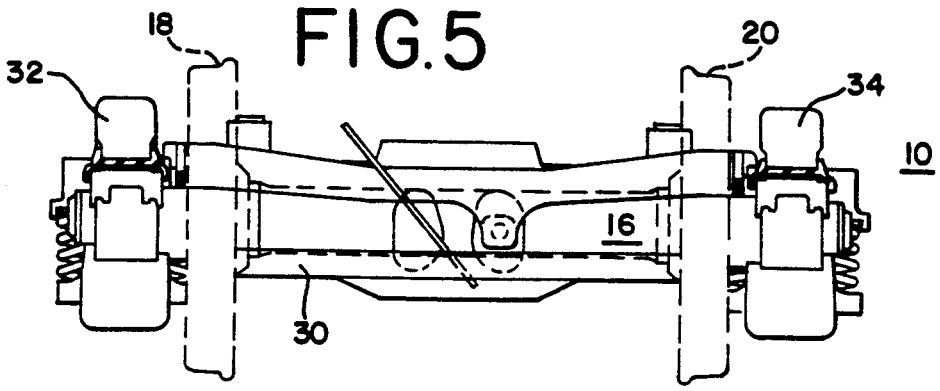
FIG. 5 is a front elevational view of the truck and steering assembly of FIG. 3; and, FIG. 6 is an enlarged view of a corner junction between the sidearm and cross-beam in FIG. 1.

In FIGS. 3–5, railway truck 10 is illustrated in both plan and elevational views with first and second wheelsets 12 and 14, respectively, and a bolster 30, which wheel sets 12, 14 and bolster 30 are transversely coupled to the longitudinal direction of side frames 32 and 34 at their approximate mid-length. Wheelset 12 includes an axle 16 with wheels 18 and 20 mounted at opposed axle ends 21, 23. Wheelset 14 is similarly arranged with axle 22 and wheels 24, 26 at axle ends 25, 27. End cap and bearing assemblies 28 at the ends of each axle 16 and 22 provide for smooth rotation of wheelsets 12 and 14. In FIG. 4, truck 10 has side frame 34 secured to an end of bolster 30 and side frame 32 is similarly secured to the other end of bolster 30. Side frame 34 includes forward pedestal 36 and rear pedestal 38 to receive bearing assemblies 28 of axles 16 and 22, respectively. Similarly, side frame 32 has forward and rear pedestals 40, 42 on its opposite ends for bearing assemblies 28 of axles 16 and 22.

Truck 10 in FIGS. 3–5 includes a steering arm assembly 50, which has a first or forward subassembly 52 and a second or rear subassembly 54, which subassemblies are coupled to axles 16 and 22, respectively, at the axle ends 21, 23, 25 and 27, respectively. As front and rear steering-arm subassemblies 52 and 54 are similarly constructed only rear steering-arm subassembly 54 will be described but the description will also apply to subassembly 52.

Assembly 50 has a thin, planar profile as shown in FIG. 2, and it is designed to fit into a relatively narrow space to perform a rigorous mechanical control function in a demanding environment. In FIG. 1, assembly 50 with subassemblies 52 and 54 is illustrated in an enlarged plan view, which subassemblies are generally centrally coupled at their cross-beams 60 by respective necks 53, 55. Cross-beam 60 of subassembly 54 has first and second sidearms 62 and 64, which sidearms 62 and 64 are similar and thus the description of sidearm 62 will apply to sidearm 64. Sidearm 62 is coupled to cross-beam 60 at upper body portion 66, which extends from and is generally parallel to cross-beam 60, and has its end 67 in proximity to side frame 34 in FIG. 3. Longitudinal segment or section 68 is coupled to end 67 and extends about normal to body portion 66 in the plane of assembly 50. A coupler device 70 at the extremity of each longitudinal segment 68 is provided for mounting and securing subassembly 54 and, thus steering arm 50, to an axle 16 or 22, and side frame 32 or 34.

Assembly 50 maintains wheel stability in railway truck 10, especially for heavy tonnage loads in curves and light tonnage loads operated at relatively high speeds. The relatively long, tapered longitudinal segment or sidearm 68 in FIG. 1 is coupled to the wheel axle end 27 and is continuously subjected to all the random flexing from truck axle and wheel motions. Longitudinal segment 68 extends from body portion 66 at about right angles to transverse axis 72, which is coincidental with the longitudinal axis of cross-beam 60. Inner sidewall 74 of segment 68 is tapered to a more narrow width from its intersection or shoulder 76 at body portion 66 to approximately midway along the length of longitudinal segment 68.

In mating-member joints susceptible to flexural loading, such as at shoulder 76, shaped or more rounded corners have been utilized to strengthen such joints, especially where a long lever arm provides a mechanical advantage to promote cracking, crack propagation and failure in fatigue. A corner with a larger radius or a thicker corner with more mass in the corner have been among the methods and designs utilized to overcome or minimize the consequences from potential fatigue force conditions in this region. In FIG. 1, the critical separation distance, "Y", is noted between the sidewalls of the respective longitudinal segments 68 of subassembly 52. The minimal clearance and spacing between the several components, such as wheel 18, junction 76, longitudinal segment 68 and body portion 66, is at a premium as noted in FIGS. 1 and 3. Therefore, the opportunity to provide shoulder 76 with either more mass or a greater radius is very small.

Longitudinal segment 68 suffers its largest flexural strain at cross-sectional width "X" of junction or shoulder 76, 77, which is greater than the cross-sectional width of longitudinal segment 68 along its length or at bearing assembly 28. Present steering arm assemblies utilize a single-radiused corner at the junction 76 between body portion 66 and longitudinal segment 68, which corner rounding is a standard practice in most machined or assembled parts to avoid sharp notches. An enlarged view of junction 76 between body portion 66 and longitudinal segment 68 in the preferred embodiment is shown in FIG. 6 and includes a first arc segment 80 with a first radius 82 and a tangentially blended second arc segment 84 with a second radius 86. The dual-radius corner appears as a continuous arc, which is broadly the condition for an ellipse and provides a compound fillet at junction 76. The compound fillet, or two arc segments with different radii, at junction 76 selectively provides and positions greater mass in junction 76 without disrupting the spatial order of the components of either truck 10 or steering arm 50, or encumbering operation of wheels 18, 20, 24 and 26. The compound fillet or dual-radius structure provides greater strength in corner 76 between longitudinal segment 68 and body portion 66, which reduces the stress at corner 76 to increase the fatigue life of sidearm 62 and, allows greater force loading of sidearm 62 and thus steering arm assembly 54. Similar elliptical configurations or compound fillets in each corner or junction 76 of subassemblies 52, 54, and thus assembly 50, provides greater control capability in trucks 10 and the associated rail cars (not shown). In a preferred embodiment, the first and longer radius 82 is greater than one and one half inches and the second and lesser radius 86 is less than one inch.

That is, independent of the relative lateral position of the steering arms and truck frame elements.

The magnitude of the impact of this seemingly small structural change in a large mechanical assembly 50 produces both unexpected and dramatic consequences. Structural stress tests on a steering arm assembly, with compound fillet corners have shown stress reductions between 28(%) percent and 51(%) percent from the stresses on a standard single radius corner assembly at the same applied force. The tests were conducted on a single steering-arm U-section 52, 54 mounted in a static test stand. This test-stand arrangement has been utilized for similar tests to analyze other steering arm assemblies, and has been found to provide satisfactory and consistent results indicative of test piece performance characteristics.

While only a specific embodiment of the invention has been described and shown, it is apparent that various alternatives and modifications can be made thereto. Those skilled in the art will recognize that certain variations can be made in this illustrative embodiment. It is, therefore, the intention in the appended claims to cover all such modifications and alternatives as may fall within the true scope of the invention.

I claim:

1. In a steering arm assembly for lateral control of a railway car truck having a pivotal truck frame with a longitudinal axis, said truck frame including a first side frame element and a second side frame element, which first and second side frame elements are about parallel, each said first and second side frame element having a mid-region, a forward end and a rear end, a transverse frame element extending between said first and second side-frame element mid-regions, a pair of longitudinally spaced wheelsets, each said wheelset having an axle with spaced apart wheels fixed thereon, a wheelset mounted at each of said forward end and rear end of said side frame elements;

said steering arm assembly having a first U-shaped steering arm and a second U-shaped steering arm, each said first and second steering arms having a cross beam with a first end and a second end, each of said first and second steering arms having a first sidearm and a second sidearm, one of said first and second sidearms secured to said cross-beam first end and the other of said first and second sidearms secured to the other of said cross-beam first and second ends, each said sidearm forming an inner junction with said cross-beam and longitudinally extending from said cross-beam for connection to an axle, which sidearms are generally normal to said cross-beam and parallel to the other of said first and second sidearms, said first and second steering arms operable to provide transmission of steering forces form one of said wheelsets to the other of said wheelsets independent of the relative lateral position of the steering arms and truck frame elements;

said junctions at each of said first and second steering arms with said cross-beam comprising a compound fillet having a first radius in proximity to said cross-beam and a second radius in proximity to said connected sidearm, which second radius is greater than said first radius to provide a larger arced segment at each said junction for increased flexural strength at said junction while maintaining adequate clearance for said wheels and truck elements.

2. In a steering arm assembly for a railway car truck as claimed in claim 1, wherein said first radius is less than one inch and said second radius is greater than one and one-half inches.

3. In a steering arm assembly for a railway truck as claimed in claim 1, each said first sidearm and second sidearm having a longitudinally extending portion and a body portion approximately parallel to said cross beam at coupling of said sidearm and said cross beam, and said compound fillet junction is provided a the intersection of said sidearm body portion and said longitudinally extending portion.

4. In a steering arm assembly for a railway car truck as claimed in claim 3, said compound fillet having a first radius in proximity to said body portion and a second radius in proximity to said longitudinally extending portion, which second radius is greater than said first radius.

* * * * *